United States Patent [19]

Elspass

[11] Patent Number: 4,649,797

[45] Date of Patent: Mar. 17, 1987

[54] GUN BARREL WITH REDUCED, REPEATIVE JUMP ANGLE

[75] Inventor: Marold Elspass, Kaarst, Fed. Rep. of Germany

[73] Assignee: Rheinmetall GmbH, Duesseldorf, Fed. Rep. of Germany

[21] Appl. No.: 657,795

[22] Filed: Oct. 4, 1984

Related U.S. Application Data

[63] Continuation-in-part of Ser. No. 384,490, Jun. 3, 1982, abandoned.

[30] Foreign Application Priority Data

Jun. 4, 1981 [DE] Fed. Rep. of Germany ..... 3122127

[51] Int. Cl.[4] ..... F41F 17/02

[52] U.S. Cl. ..... 89/14.05; 42/76.01

[58] Field of Search ..... 89/14.05; 42/76 R, 75 B

[56] References Cited

U.S. PATENT DOCUMENTS

| | | | |
|---|---|---|---|
| 214,260 | 4/1879 | Merriam | 89/14.05 |
| 2,780,019 | 2/1957 | Sullivan | 89/14.05 |
| 3,732,778 | 5/1973 | Bettermann et al. | 89/14.05 |

FOREIGN PATENT DOCUMENTS

| | | | |
|---|---|---|---|
| 363416 | 10/1938 | Italy | 89/14.05 |
| 373881 | 8/1939 | Italy | 42/76 R |
| 5245 | of 1886 | United Kingdom | 89/14.05 |
| 237984 | 8/1925 | United Kingdom | 89/14.05 |
| 661546 | 11/1951 | United Kingdom | 42/75 B |

OTHER PUBLICATIONS

Rheinmetall, Waffentechnisches Taschenbuch, 1977, pp. 272–273, 291, 108–111.

*Primary Examiner*—Deborah L. Kyle
*Assistant Examiner*—S. Johnson

[57] ABSTRACT

An improved gun barrel in a tank cannon assembly having a recoiling mass is described. This gun barrel has an increased target impact precision by virtue of stabilizing the bending oscillations and/or vibrations during firing, thereby making the jump angle more uniform from one firing to the next one. The L/D ratio of the gun barrel is larger than 52 (where L represents the length of the gun barrel and D represents the caliber diameter). The gun barrel jacket has a frusto-conically shaped portion extending from the muzzle towards the rear of the gun barrel which is adjoined by a cylindrically shaped portion. The gun barrel is supported on a cradle along the latter portion. The gun barrel exhibits a continuous unbuckled bending line in its static and dynamic conditions between its muzzle and the cylindrical jacket portion. The frusto-conically shaped and cylindrically shaped portions merge into each other and have identical diameters along their merging line. The cylindrically shaped jacket portion is supported with respect to the firing direction along a distance a which is <7 D. The center of gravity of the recoiling mass is disposed within the frusto-conically shaped jacket portion of the gun barrel.

4 Claims, 1 Drawing Figure

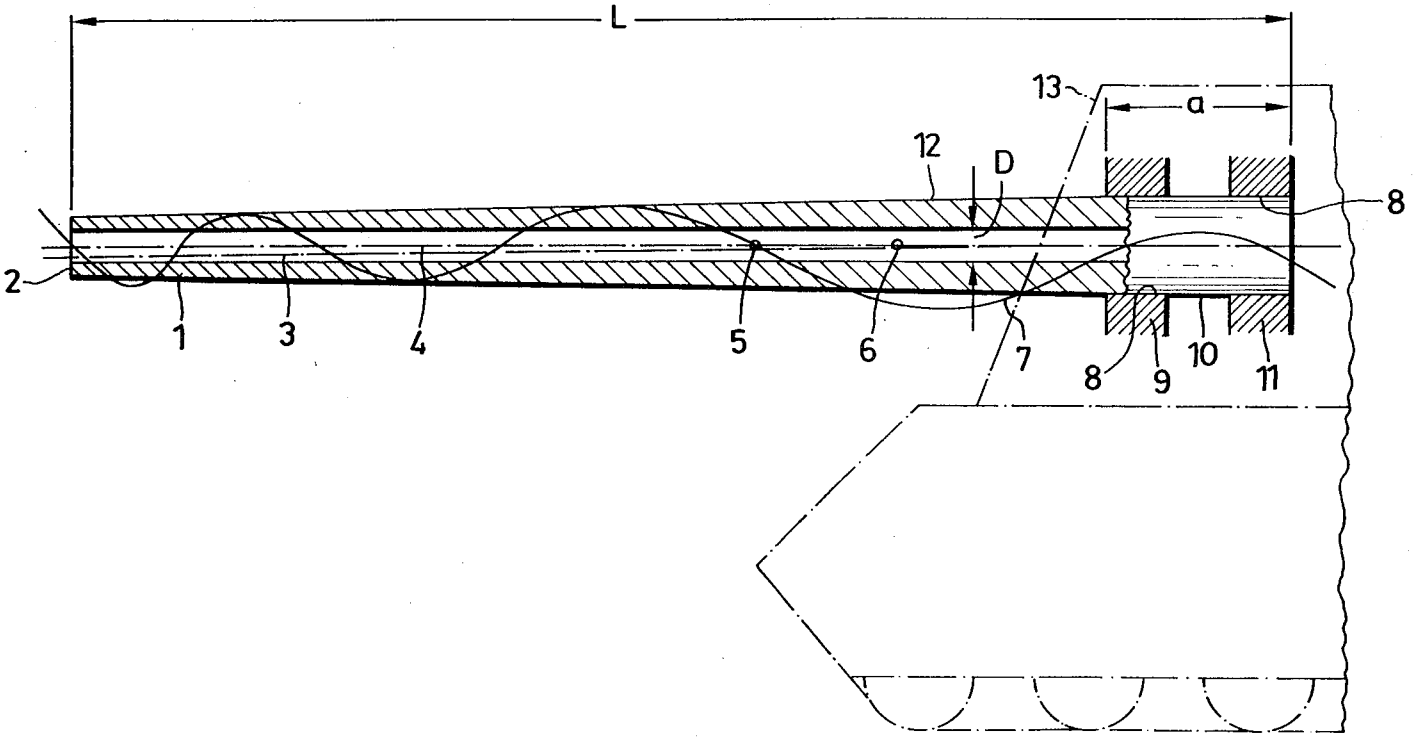
8
11
10
9
8
a
13
7
D
12
6
5
L
4
3
1
2

GUN BARREL WITH REDUCED, REPEATIVE JUMP ANGLE

CROSS-REFERENCE TO RELATED APPLICATION

This application is a continuation-in-part application of my copending application Ser. No. 384,490, filed on June 3, 1982 now abandoned.

BACKGROUND OF THE INVENTION

This invention relates to a gun barrel of the type which can, for example, be used as a heavy, large-caliber gun barrel adapted to be mounted on tanks or the like (i.e. a tank cannon).

Many types of gun barrels form part of the state of the art. A primary object of the designers for all types of gun barrels is to achieve an increased target impact accuracy. To achieve this goal the gun barrels are (a) generally lengthened; (b) the length of the gun barrel along which it is supported is adjusted, or (c) other steps are taken which result in a reduction of the jump angle. There has been established as a standard, in particular for gun barrels mounted on tanks, a construction which includes a plural-stepwise-reduction of the gun barrel jacket diameter, which gun barrel is mounted in a support having a short supporting width. In order to increase the mass moment of inertia and to decrease the oscillations and vibrations of the barrel, the center of gravity of the recoiling mass was transferred from the support region of the gun barrel in the direction towards the muzzle of the gun barrel.

An arrangement for a gun barrel for reducing the jump angle of the projectile is described, for example, in German Pat. No. 19 11 067 (corresponding to U.S. Pat. No. 3,732,778). In this patent there is described an arrangement whereby there are mounted in the forward region of the gun barrel bending-oscillation-dampening stiffening members.

Such prior art gun barrels generally have a ratio of $L/D>52$ (where L=axial length of the barrel and D=bore diameter). Such known gun barrels may have a stepwise reduction of the gun barrel jacket or a frustoconical shape for the jacket whereby the exterior diameter of the gun barrel progressively diminishes in the direction toward the muzzle and may also have a constant internal bore diameter. Prior art gun barrels are generally supported along an exterior cylindrical rear portion of the gun barrel by means of front and rear cradles for absorbing the recoil and counter-recoil loads. Such known gun barrels are generally joined to additional recoiling massive parts at their rear portion. Such known gun barrels are, for example, described on page 316 of the HANDBOOK ON WEAPONRY by Rheinmetall published by Broenners Druckerei Breidenstein GmbH. Copyright 1982. The gun barrel of FIG. 833 has a stepped outer diameter jacket in its middle region and has a gun barrel support width of 7D. In the same publication there is shown in FIG. 927 a gun barrel in which the center of gravity is disposed between the front and rear cradles. There are also known gun barrels having a frustoconically shaped internal bore.

While the gun barrel described in U.S. Pat. No. 3,732,778 is designed to reduce the jump angle of a fired projectile, it can maintain essentially the same jump angle from one firing to the next. This drawback is due to changes in rigidity along the gun barrel which causes, in coaction with large support widths of >7D, short whip lengths during firing. Also the center of gravity of the recoiling mass is disposed between the support cradles which results, at firing, in an indifferent support and leads to strong jump angle deviations causing unequal impulses from one firing to the next one.

It has been established that high-frequency bending oscillations of the gun barrel, which precede the projectile during its traverse through the barrel, negatively influence the target impact precision. The impact precision is primarily influenced by the jump angle, at which the projectile deviates from the target direction as it exits from the muzzle of the gun barrel.

In addition to the means described in U.S. Pat. No. 3,732,778 there exist a plurality of other parameters which influence the jump angle. Exemplary of such parameters are the constructional design data regarding the barrel, such as its mass distribution moment of inertia location inclusive of supplementary masses which are secured to the gun barrel, elastic rigidity of the barrel and the like, and constructional design data of the gun barrel support, for example width of the support, bearing clearance and the like, thereby disregarding other types of influences. It has been found to be particularly disadvantageous in gun barrels having a stepwise reduced gun barrel jacket diameter, having an exterior diameter reduction which progresses from the front support position of the barrel towards the muzzle, and in indifferently supported barrels, that uneven oscillation-causing pulses from firing to firing occur, which by themselves are already capable to cause purely incidental jump angles.

SUMMARY OF THE INVENTION

The invention has as its principal object to provide a gun barrel of the afore-described type, in which the barrel-bending-oscillations are influenced in such a way that a constant jump angle sets itself with the object of effecting a vertical jump angle input in the firing control computer and thereby an increase of the impact precision is attained as well as a substantial increase in performance of the gun barrel.

This object of the invention is achieved in that a gun barrel of the afore-described type (i.e. a tank cannon) is provided with a jacket in the shape of a truncated cone having a continuous extending unbuckled bending line, which jacket portion merges with a cylindrical portion of the gun barrel jacket which coacts with the gun barrel support. This jacket is disposed in its static and dynamic condition in the region between the muzzle and the support. The cylindrical region for the gun barrel support has a maximum length of no more than 7D (D=diameter of gun barrel bore or caliber of gun barrel); and the center of gravity of the recoiling mass is disposed in the region of the gun barrel jacket which has the afore-described shape of a truncated cone.

The truncated-conical longitudinal shape of the gun barrel jacket in accordance with the invention, in the region between the gun barrel support and the muzzle renders, compared to the gun barrel jacket having a stepped periphery, has a substantial increase in barrel rigidity, thereby in its static and dynamic condition the bending lines of the gun barrel exhibit a continuous unbuckled course. Based on the recognition that the barrel support and in particular the support width and the bearing clearance have a substantial effect on the jump angle, there is provided for the barrel support a short support length in the region 6D to 7D (D=diameter of gun barrel bore or caliber of gun barrel) and a center of gravity shift of the recoiling mass into the conical region of the gun barrel, so that the barrel support does not lift off from its forward and rearward support position.

By means of these measures the amplitude of the oscillation is reduced during the projectile traverse in the region outside of the support for the gun barrel. In particular by means of the continuously decreasing diameter of the gun barrel jacket the barrel oscillations from firing to firing receive a steady course, whereby a substantially constant jump angle is achieved.

The invention renders further advantages in that the increase of the moment of inertia not only achieves oscillation-dampening, but reduces the recoil path of the recoiling parts and in view of the long barrel construction the departure velocity of the projectile is increased.

The invention proposes to provide a truncated-conical longitudinal shape of the gun barrel jacket which causes the bending line to be continuously unbuckled even during the dynamic condition of the gun barrel. When the gun barrel length to bore diameter ratio $L/D > 52$ a relatively short support width of 6D to 7D is required which causes the center of gravity 6 to be shifted forwardly into the truncated-conical longitudinal portion of the gun barrel thereby avoiding a lifting off of the gun barrel from the front and rear cradles 9 and 11. By maintaining thereafter-described parameters the jump angle becomes substantially more uniform from one firing to the next one.

BRIEF DESCRIPTION OF THE DRAWING

With these and other objects in view which will become apparent in the following detailed description, the present invention, which is shown by example only, will be clearly understood in connection with the single FIGURE of the accompanying drawing in which:

The gun barrel 1 is shown schematically in side elevation as mounted on a tank 13. The barrel 1 has a gun barrel bore length L and a caliber diameter D and exhibits a relationship $L/D > 52$. The gun barrel assembly also has a support having a defined width which gun barrel support construction includes cradle supports 9 and 11 having a width of $<7D$. The Gun barrel jacket disposed within this gun barrel support width has a cylindrical shaped portion 10. Starting from the end of the support member 9 the gun barrel 1 has a peripheral shape towards and up to the muzzle 2 which is of truncated-conical shape and there are no stepped portions in this part of the gun barrel jacket. The support members 9 and 11 of the gun barrel 1 are disposed in the non-illustrated cradle (which construction can, for example, be mounted on tank 13). Reference number 6 illustrates the center of gravity of those parts which recoil with the barrel during firing. The recoiling parts are typically composed of the counter recoil mechanism, the barrel brake mechanism and eventually other parts, such as for example the loading mechanism, and this assembly forms the so-called recoiling mass. The center of gravity 6 of the recoiling mass is disposed within the frusto-conical shaped region of the gun barrel 1 in front of the support member 9 and furnishes a stable mounting of the gun barrel between the gun barrel support positions 9, 11 and the cylindrical gun barrel jacket region 10.

The course of the oscillatory motions of the bending oscillations caused during firing which occur in the gun barrel are schematically illustrated by means of a curve 7, whereby reference number 4 represents the theoretical gun barrel axis and reference number 3 represents the unbuckled extending bending line of the real gun barrel axis, which is brought into being by the forces which act statically on the gun barrel about which the oscillations really occur. The jump angle is not illustrated, with which the projectile deviates from the firing direction as it leaves the muzzle 2.

Although the invention is illustrated and described with reference to one preferred embodiment thereof, it is to be expressly understood that it is in no way limited to the disclosure of such a preferred embodiment, but is capable of numerous modifications within the scope of the appended claims.

I claim:

1. An improved gun barrel having an increased target impact precision by stabilizing the bending oscillations of the gun barrel during firing, the gun barrel having a ratio $L/D \geqq 52$ where L represents the length of the gun barrel and D represents the caliber diameter, and further having a cylindrical gun barrel jacket portion and a frusto-conical gun barrel jacket portion adjoining said cylindrical jacket portion, said gun barrel being supported along its cylindrical jacket portion and being operatively connected with additional parts of the gun assembly which form a recoiling mass, the improvement comprising:

(a) wherein the frusto-conical gun barrel jacket portion extends from the muzzle of the gun barrel to said cylindrical jacket portion;

(b) during its static and dynamic condition the gun barrel exhibits a continuous unbuckled bending line between its muzzle and the cylindrical jacket portion;

(c) said frusto-conical jacket portion merges into said cylindrical portion;

(d) said cylindrical jacket portion being supported along a distance a which is larger than 6D and smaller than 7D; and (e) wherein the center of gravity of the recoiling mass is disposed within the frusto-conical jacket portion of the gun barrel.

2. The improved gun barrel as defined in claim 1, wherein the center of gravity of the recoiling mass is disposed in the static condition of the assembly between the center of gravity of the gun barrel and the most forward extent with respect to the firing direction of the cylindrical jacket portion which is being supported.

3. The improved gun barrel as defined in claim 2, wherein the exterior diameter of the frusto-conical jacket portion at the line where it merges with cylindrical jacket portion is identical to the diameter of the latter.

4. The improved gun barrel as defined in claim 3, wherein the cylindrical gun barrel jacket portion of the gun barrel does not lift off the gun barrel support during firing from the forward and the rearward longitudinal extent, with respect to the firing direction along the cylindrical jacket portion, but forms a stable mount thereon.

* * * * *